United States Patent [19]

Stein

[11] Patent Number: 4,805,493

[45] Date of Patent: Feb. 21, 1989

[54] HOT RADIATOR CAP AND PRESSURE REMOVER

[76] Inventor: Locke M. Stein, R.R. 2, Spearville, Kans. 67876

[21] Appl. No.: 512,741

[22] Filed: Jul. 11, 1983

[51] Int. Cl.[4] ..... B67B 7/00

[52] U.S. Cl. ..... 81/3.44; 81/383; 81/426.5; 294/119

[58] Field of Search ..... 81/3.44, 3.42, 381, 81/383, 425 A, 3.4; 294/118, 119

[56] References Cited

U.S. PATENT DOCUMENTS 1,549,836 8/1925 Hopp ..... 294/119

3,048,067 8/1962 Miles et al. ..... 81/3.4 X 3,384,411 5/1968 Zlotnicki ..... 81/381 X 3,817,126 6/1974 Koebbeman ..... 81/3.44

*Primary Examiner*—James G. Smith

*Attorney, Agent, or Firm*—Fleit, Jacobson, Cohn & Price

[57] ABSTRACT

A tool for the release of pressure in a hot automobile radiator comprises elongated tongs having jaws at one end for gripping the radiator cap and handgrips at the other end. The tool may be manipulated to loosen the cap from a position removed from the radiator so as to reduce the risk of personal injury due to a sudden release of pressure when the cap is loosened.

13 Claims, 1 Drawing Sheet

HOT RADIATOR CAP AND PRESSURE REMOVER

BACKGROUND OF THE INVENTION

This invention relates to a tool which may be used for the release of pressure and removal of the cap of a hot radiator in an automobile and the like.

Scalding or other personal injuries may occur when manually removing the cap of a hot or boiling vehicle radiator, due to the sudden release of pressure when the cap is loosened, with the possible accompaniment of steam emission and even forcible expulsion of the cap itself. The present invention seeks to provide a tool which may be used by service station attendants, vehicle owners or others, to remove a radiator cap while protecting the user against such eventualities.

STATEMENT OF PRIOR ART

Applicant is aware of the following U.S. patents showing diverse forms of gripping tools: U.S. Pat. Nos. 1,549,836, 2,404,991, 3,037,408, 3,384,411, 3,492,587.

SUMMARY OF THE INVENTION

The present invention provides a tool for use in removing a radiator cap, and which a user can operate while standing at a distance from the radiator, thereby minimizing the risk of personal injury due to the release of pressure when the cap is loosened.

A tool in accordance with the invention may, for example, comprise elongated tongs, e.g. of about 3 feet in length, with cap-engaging and gripping jaws at one end, and handgrips at the other end. The jaws may each comprise curved, concave elements adapted to fit around and embrace a radiator cap, with the diametrically opposed protruding ears of the cap located between suitably shaped terminal portions of the respective jaws, whereby torque may be applied to the cap by squeezing the handgrips and turning the tool about the axis of the cap. To facilitate use in manipulation of the tool, it may comprise a multiple-element linkage in the style of lazy tongs having a specified geometry.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
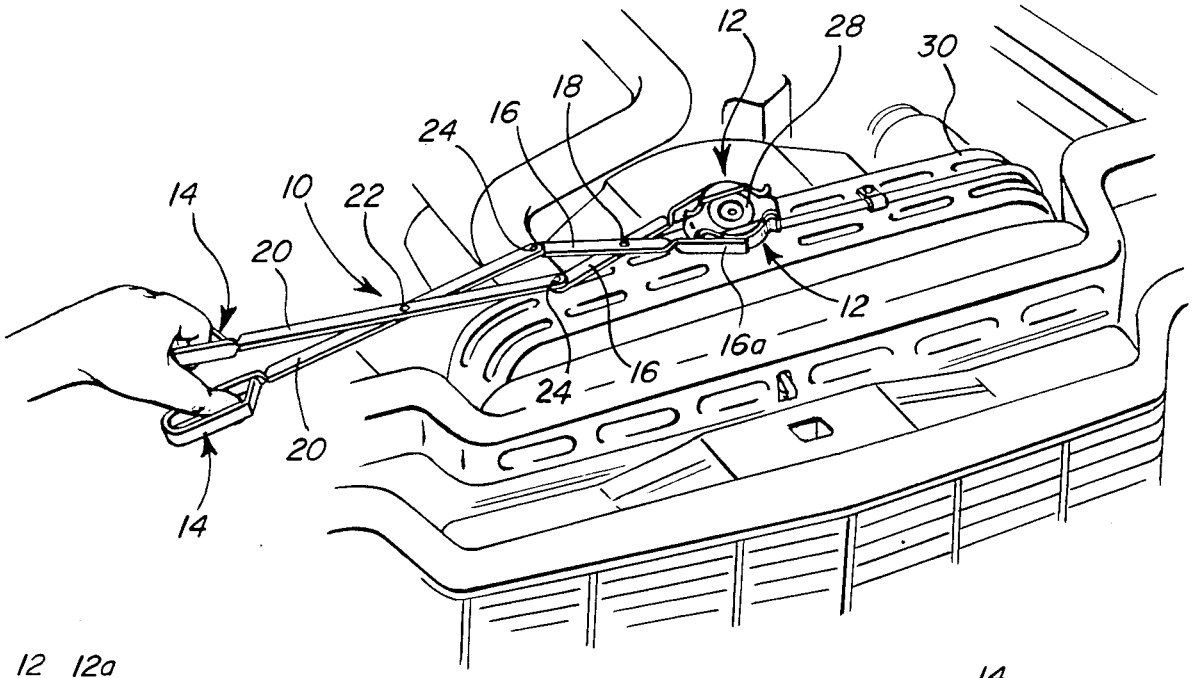
FIG. 1 is a perspective view illustrating the use of a radiator cap gripping tool in accordance with the invention.
Figure 2:
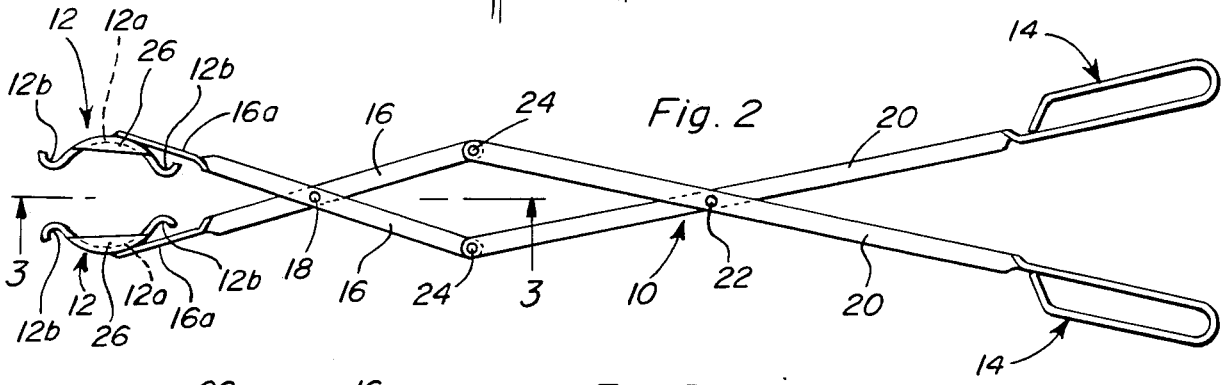
FIG. 2 is a plan view of the tool illustrated in FIG. 1.
Figure 3:
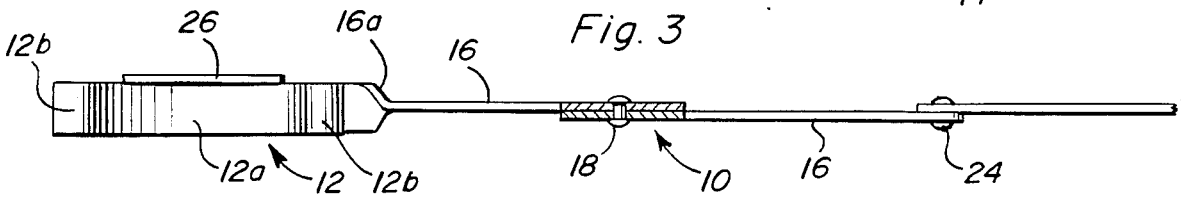
FIG. 3 is a cross-sectional view to an enlarged scale on line 3—3 of FIG. 2.

A hot radiator pressure releasing tool in accordance with the invention comprises elongated tongs 10 having jaws 12 at one end, and handgrips 14 at the other end. The tongs may comprise a pair of primary links 16, one end 16a of each of which is twisted and has one of the jaws attached thereto, links 16 being pivotally interconnected by a rivet or the like, and a pair of secondary links 20 provided with the handgrips 14, links 20 being pivotally interconnected by a rivet 22 or the like. The adjacent ends of the respective links 16 and 20 may be pivotally interconnected by rivets 24 or the like. The primary links may be shorter than the secondary links, for example, the primary links may be of the order of 12 inches in length and the secondary links may be of the order of 24 inches in length. Handgrips 14 may be formed by appropriately twisting and bending end portions of the secondary links. The links may, for example, be formed from $\frac{1}{8}'' \times \frac{3}{8}''$ plate. To facilitate manipulation of the tongs, rivet 18 may conveniently be located approximately midway between the respective ends of links 16, while rivet 22 may be located at a distance from rivet 24 corresponding to about one-third the length of links 20.

Jaws 12, which may be welded to the ends of links 16, may each be formed from similar plate to that of the links, and may be curved to provide a concave central portion 12*a* shaped to conform to the curvature of a standard radiator cap, and reversely curved outwardly extending end portions 12*b*. Segment plates 26 may be welded on the tops of central portions 12*a* of the jaws.

Figure 4:
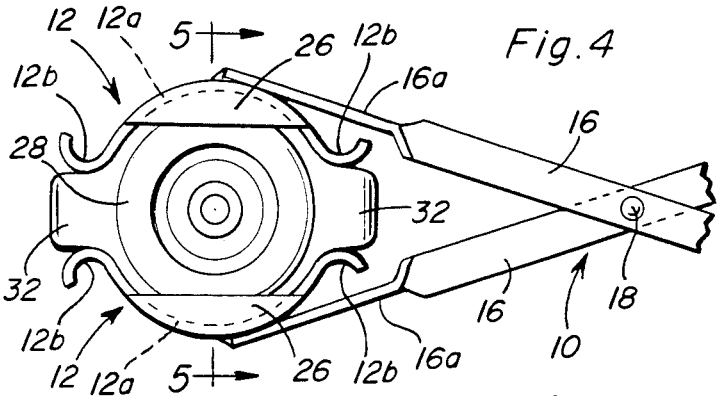
FIG. 4 is a plan view of a front end of the tool in engagement with a radiator cap.
Figure 5:
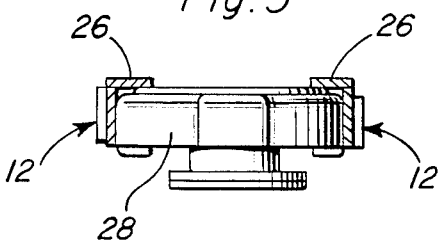
FIG. 5 is a view on line 5—5 of FIG. 4.

In use, to remove a cap 28 of a radiator 30, handgrips 14 may be used, as shown in FIG. 1, to manipulate jaws 12 into embracing engagement around the cap, with the diametrically opposed cap ears 32 being situated between the respective jaw end portions 12*b* (see FIG. 4), and plates 26 serving to facilitate proper location of the jaws on the cap. Then, the tool may be used to rotate the cap by applying inward pressure on the handgrips and turning the tool about the axis of the cap. Thus, torque is applied to the cap by means of the end portions 12*b* of jaws 12 bearing on the respective cap ears. The overall length of the tool and its multiple link, lazy tong configuration facilitates the application of torque to the radiator cap from a position remote from the cap, thereby minimizing the risk of personal injury to a user when radiator pressure is released by loosening of the cap by rotating it a partial turn to engage the safety stops so that the pressure in the radiator can be vented to atmosphere through the overflow tube and auxiliary expansion tank after which the cap can be removed. The length of the tool is such that downward force on the radiator cap sufficient to move the lugs thereon downwardly to pass under the safety stops cannot be accidentally applied thereby assuring that the cap cannot be completely removed until after it has stopped at its venting or pressure reducing position.

The foregoing is considered as illustrative only of the principle of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A tool for releasing pressure in a hot radiator by applying a loosening torque to the radiator cap, the tool comprising elongated tongs formed from pivoted links, the tongs having jaws at one end adapted to embrace and apply torque to the radiator cap, and handgripping portions at the other end for opening and closing the jaws from a position removed from the cap, wherein each jaw has a concave central portion curved to embrace a radiator cap and outwardly extending end portions, the jaws being related to the links for the central portions to embrace the cap and for diametrically opposed protruding ears of the cap to fit between the end portions of the respective jaws for the application of torque to the cap when the jaws are closed toward one another by manipulation of the links, and wherein each jaw includes a locating plate on top of the central portion for engaging the top of the cap.

2. The tool as claimed in claim 1 wherein the end portions of each jaw are reversely curved relative to the central portion.

3. The tool as defined in claim 1 wherein the tongs have a length of the order of 3 feet.

4. The tool as defined in claim 1 wherein the tongs comprise a pair of pivotally interconnected primary links with the jaws attached to one end thereof, and a pair of pivotally interconnected secondary links, the secondary links themselves being pivotally connected at one end thereof to the opposite ends of the primary links.

5. The tool as claimed in claim 4 wherein the handgripping portions are provided at the opposite ends of the secondary links.

6. A radiator cap pressure releasing and removal tool in the form of elongated tongs comprising a pair of pivotally interconnected primary links each having a cap-engaging jaw at one end thereof, and a pair of pivotally interconnected secondary links for opening and closing the jaws, the secondary links being pivotally interconnected at one end of each to the ends of the respective primary links opposite said jaws, wherein each jaw comprises a strip of plate having a central concave portion curved to embrace a radiator cap, outwardly extending ends portions for receiving opposed ears of the cap therebetween when the jaws are closed toward one another and a top plate on the central portion for engaging the top of the radiator cap.

7. A tool as claimed in claim 6 wherein the primary links are shorter than the secondary links.

8. A tool as defined in claim 7 wherein the primary links are about 12 inches long and the secondary links are about 24 inches long.

9. A tool as defined in claim 6 wherein the secondary links are provided with handgripping portions at the ends opposite to the ends which are connected to the primary links.

10. A tool as defined in claim 8 wherein the pivotal interconnection between the primary links is situated approximately midway between the respective ends of the primary links and the pivoted interconnection between the secondary links is situated at a distance from the connections with the primary links corresponding to about one-third the length of the secondary links.

11. A tool as defined in claim 9 wherein the handgripping portions comprise encircling handgrips.

12. A tool as defined in claim 11 wherein the secondary links are bent to provide the handgrips.

13. A tool as defined in claim 6 wherein the top plate of each jaw is in the shape of a segment of a circle with a curved edge conforming with the curve of said concave portion of said strip.

* * * * *